343-756 SR
10/27/81 OR 4,297,710

United States Patent [19]
Dupressoir

[11] 4,297,710
[45] Oct. 27, 1981

[54] PARALLEL-PLANE ANTENNA WITH ROTATION OF POLARIZATION

[75] Inventor: Albert Dupressoir, Paris, France

[73] Assignee: Thomson-CSF, Paris, France

[21] Appl. No.: 127,097

[22] Filed: Mar. 4, 1980

[30] Foreign Application Priority Data

Mar. 9, 1979 [FR] France ..... 79 06135

[51] Int. Cl.[3] ..... H01Q 19/195
[52] U.S. Cl. ..... 343/756; 343/780; 343/781 P; 343/786; 343/840
[58] Field of Search ..... 343/756, 780, 781 R, 343/781 P, 840, 909

[56] References Cited

U.S. PATENT DOCUMENTS 2,942,266 6/1966 Mattingly ..... 343/756
3,771,160 11/1973 Lauerick ..... 343/756
3,820,116 6/1974 Carlsson et al. ..... 343/756
3,916,416 10/1975 Lewis ..... 343/756

*Primary Examiner*—Eli Lieberman
*Attorney, Agent, or Firm*—Karl F. Ross

[57] ABSTRACT

A parallel-plane antenna of the pillbox or cheese type in which the cylindrical-parabolic portion is constituted by a semitransparent reflector and the focal plane of which is constituted by a polarizing reflector. The cylindrical-parabolic semitransparent reflector is constituted by an array of wires parallel to the plane of polarization of the wave emitted by the source. The polarizing reflector is formed by a reflecting plate located at a distance of λ/4 from an array of parallel wires inclined at 45° with respect to the plane of polarization of the incident wave.

12 Claims, 6 Drawing Figures

PARALLEL-PLANE ANTENNA WITH ROTATION OF POLARIZATION

BACKGROUND OF THE INVENTION

This invention relates to a parallel-plane antenna known as a cheese antenna or pillbox antenna.

In accordance with a generally accepted definition, a parallel-plane antenna of the cheese or pillbox type is essentially constituted by two parallel plates limited by a cylindrical-parabolic end-wall illuminated by a source placed on its focal line as shown in FIG. 1. The source can be a simple monomode horn or a multimode source. Depending on the height H or distance between the two parallel plates, a number of operating modes can be contemplated such as the TEM, TE and TM modes. Particulars on this type of antenna are given in "Les Antennes" by L. Thourel, published by Dunod, page 285, 1976 edition, and in "Microwave Antenna Theory and Design", Vol. 12, page 459 of the "Radiation Laboratories Series" (1949 edition).

A disadvantage of this type of antenna, however, lies in the fact that its radiating aperture is occulted by the source, thus having the effect of impairing the radiation characteristics of the antenna.

One solution for eliminating this occulting effect without increasing the depth of the antenna consists in constructing a parallel-plane antenna of the cheese or pillbox type having a folded configuration as shown in FIG. 2 in which the feed is separate from the radiating portion. This solution provides a higher gain than the simple pillbox or cheese antenna.

This antenna is constituted by two pillbox or cheese antennas 41 and 43 coupled together by means of a slot 44 extending over the entire length of the parabolic end-wall which is common to the two antennas. The slot 44 is so dimensioned that the assembly formed by the two cheese elements 41 and 43 and the slot 44 constitutes an adapted folded waveguide.

However, one drawback attached to these two antenna designs arises from the difficulties presented by the mechanisms employed for driving the antenna in rotation. In point of fact, the choice of an antenna having a long focal distance makes is necessary to place the excitation source at a substantial distance from the center of gravity of the antenna. This has the effect of complicating the supporting structure in proportion to said distance and increasing the capacity of the mechanisms employed for driving the turret on which the antenna is mounted.

SUMMARY OF THE INVENTION

The present invention makes it possible to overcome these disadvantages and is accordingly directed to a parallel-plane cheese or pillbox antenna of the rearfeed, rotatory polarization type.

In accordance with a distinctive feature of the invention, the parallel-plane antenna has a cylindrical-parabolic end-wall constituted by a semitransparent reflector and a plane containing the focal line of the antenna, said plane being constituted by a polarizing reflector.

One of the advantages of the invention lies in the fact that the optical path formed by means of the two reflectors is folded-back, thereby reducing the real focal distance of the antenna and therefore the overall length as well as both the volume and weight of the antenna to be driven in rotation. The semitransparent cylindrical-parabolic reflector has a long equivalent focal distance, thus permitting the use of sources which are capable of exciting the parallel-plane antenna under usual conditions of service.

A further advantage of the invention lies in the construction of a parallel-plane antenna in which the excitation source is placed at the rear.

BRIEF DESCRIPTION OF THE DRAWINGS

Further advantages and distinctive features of the invention will become apparent from the following description as illustrated in FIG. 3 which shows one example of construction of a parallel-plane antenna according to the invention. In addition.

DESCRIPTION OF EMBODIMENTS

Figure 1:
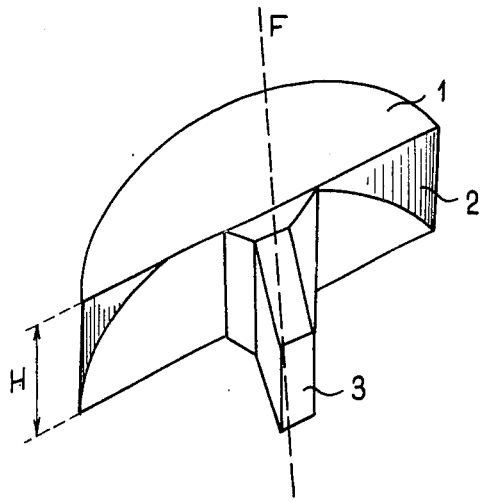
FIGS. 1 and 2 show respectively a conventional parallel-plane antenna and a folded parallel-plane antenna.

FIG. 1 illustrates a conventional parallel-plane antenna constituted by two parallel plates limited by a cylindrical-parabolic end-wall 2 illuminated by a source 3 which is placed on its focal line F. The source 3 is either a monomode horn or a multimode source. The aperture of the horn constitutes an equiphase linear source which provides a number of operating modes according to the height H or distance between the two parallel plates 1. If the height H is less than one-half the wavelength at the center frequency of the operating band $\lambda/2$, only the TEM mode can exist. In such a case the aerial is mostly known as a pillbox antenna. If the height H is greater than $\lambda/2$, the TE and TM modes can propagate and the aerial is known as a cheese antenna.

The fact that the source 3 is placed in front of the radiating aperture nevertheless produces a mask effect which impairs the radiation characteristics of the pillbox or cheese antenna.

Figure 2:
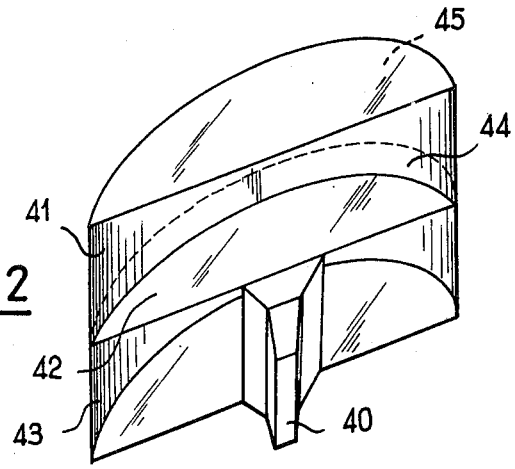

Another type of construction of a parallel-plane antenna of the pillbox or cheese type is shown in FIG. 2.

The antenna feed source 40 is separated from the radiating portion 41 by a partition-wall 42 between the feed portion 43 and the radiating portion 41. In fact, this folded pillbox or cheese antenna is constituted by two pillbox antennas or two cheese antennas coupled by means of a slot 44 which extends along the entire length of the parabolic end-wall 45. The portion 43 of the folded antenna is excited by the source 40 such as a horn, for example. The dimensions of the slot 44 are such that the assembly formed by this latter and the two cheeses 41 and 43 constitutes an adapted folded waveguide. This system achieves good results especially in the TEM mode.

Figure 3:
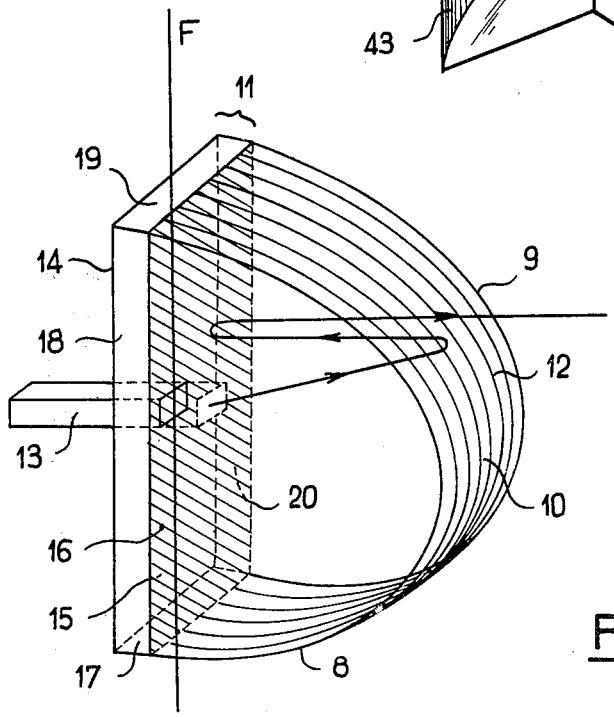

FIG. 3 illustrates a parallel-plane antenna according to the invention. This antenna is constituted by two parallel plates 8 and 9 limited on the one hand by a semitransparent cylindrical-parabolic end-wall reflector 10 and on the other hand by a plane polarizing reflector unit 11 located at right angles to the plates 8 and 9 and containing the focal line F of the antenna. The semitransparent cylindrical-parabolic reflector 10 is formed by an array of wires 12 which are parallel to the plane of polarization of the wave emitted by the source 13. The pitch of the array is small compared with the wavelength, namely 12 mm in the case of a frequency f=1300 MHz. The array therefore behaves as a waveguide which produces cutoff in respect of any wave which is polarized in a direction parallel to the wires and therefore behaves as a reflector. Thus the wave emitted by the source 13 is totally reflected from the cylindrical-parabolic reflector 10 before finally reaching the plane reflector unit 11. This plane reflector unit 11 is formed by a reflecting plate 14 and by an array 15 of wires 16 which are parallel to each other and make an angle of 45° with the plane of polarization of the wave emitted by the source. Said unit accordingly ensures rotation of polarization. The distance between the plate 14 and the array 15 is substantially equal to one-quarter of the wavelength, namely $\lambda/4$ at the center frequency of the operating band. This condition is not imperative, however, if it is desired to operate over a wide band.

Metal plates 17, 18, 19 and 20 constitute with the plane reflector unit 11 a box having the shape of a rectangular parallelepiped.

In the plane of the array 15 of parallel wires 16, the wave emitted by the source 13 and then reflected by the semitransparent cylindrical-parabolic reflector 10 can be split-up in two orthogonal directions, a first component being parallel to the wires 16 and a second component being perpendicular to said wires 16. The component which is perpendicular to the wires 16 passes through the array and is reflected by the reflecting plate 14. The parallel component does not pass through the array 15 and is reflected. Thus the perpendicular component is phase-shifted by 180° with respect to the parallel component after being reflected from the reflecting plate 14 and after having passed back through the array of wires 16. The effect of this phase lag is to produce a rotational displacement through an angle of 90° of the plane of polarization of the resultant wave which is radiated a second time by the plane reflector unit 11 to the semitransparent cylindrical-parabolic reflector 10.

The cylindrical-parabolic reflector 10 has become transparent to said incident wave, the plane of polarization of which has rotated by 90° with respect to the wave emitted by the source 13, the electric field vector of the emitted wave being perpendicular to the parallel wires of the array 12 carried by the cylindrical-parabolic reflector 10.

A so-called "folded" optical system has thus been formed. In other words, by folding-back the optical path, a cylindrical-parabolic mirror having a long equivalent focal distance can be placed within a space of small overall length, thus making it possible to employ sources which are capable of exciting the antenna under normal conditions of use.

The two arrays of parallel wires 12 and 16 can be replaced by parallel reflecting plates or by wires embedded in a glass-resin complex.

Figure 4:
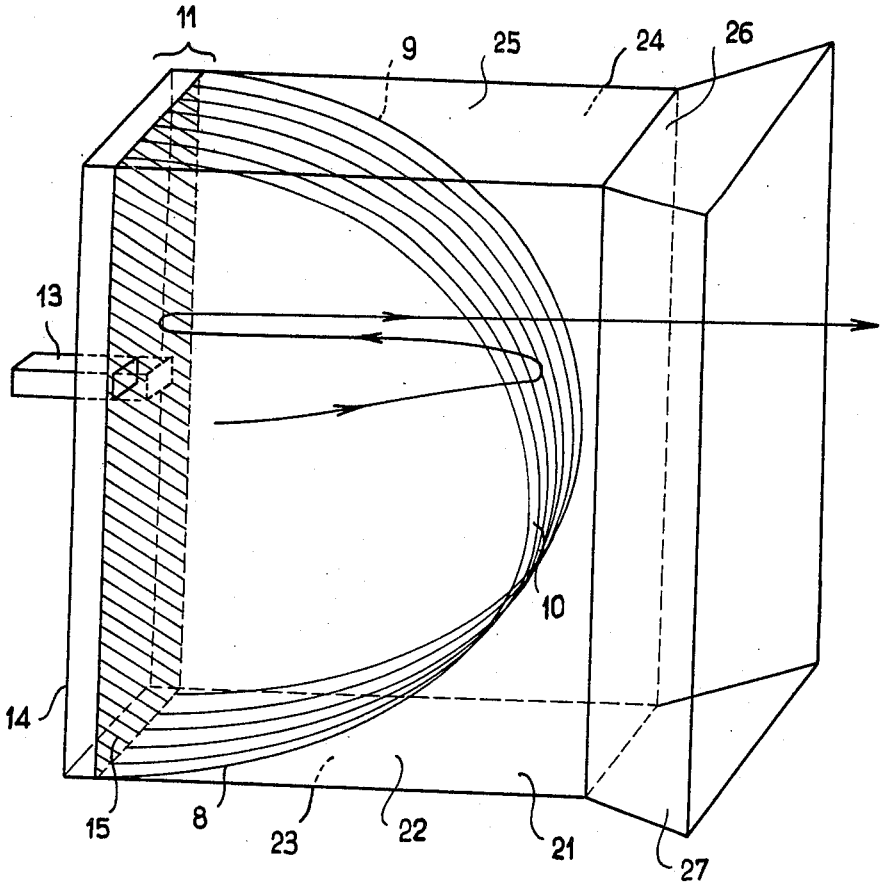

Another example of construction of a parallel-plane antenna of the cheese or pillbox type is illustrated in FIG. 4. In order to achieve enhanced directivity of the antenna, this latter is fabricated from a metallic box 21 having the shape of a rectangular parallelepiped, the bottom portion of which is constituted by the plane reflector unit 11 whilst the metal plates 22, 23, 24 and 25 constitute the side walls which are perpendicular to the bottom end-wall. The metal plates 22 and 24 which are perpendicular to the bottom end-wall constitute the two parallel plates 8 and 9 of the antenna. The bottom portion of the box is formed by the reflecting plate 14 located at a distance of $\lambda/4$ from the array 15 of wires which are parallel to each other and are inclined at an angle of 45° with respect to the plane of polarization of the wave emitted by the source. Said bottom portion is illuminated by the source 13 placed at the center of this latter in order to radiate towards the interior. An aperture 26 is formed on the entire face remote from the reflecting end-wall and can have a flared-out portion in the shape of a horn 27 in order to improve the directivity. The array 10 of parallel wires are placed within the interior of the box and arranged on a surface of cylindrical-parabolic shape in order to form the semitransparent cylindrical-parabolic reflector of the antenna.

Figure 5:
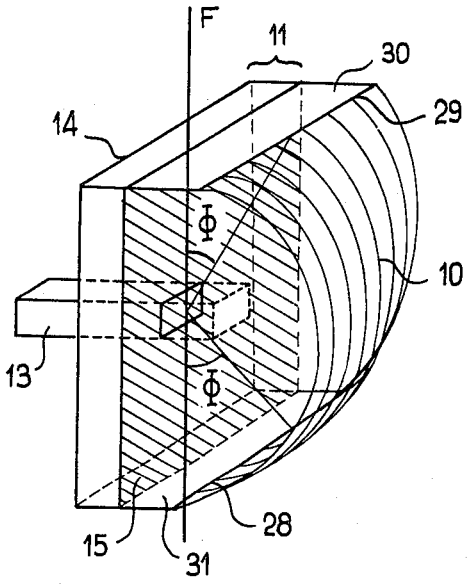
Figure 6:
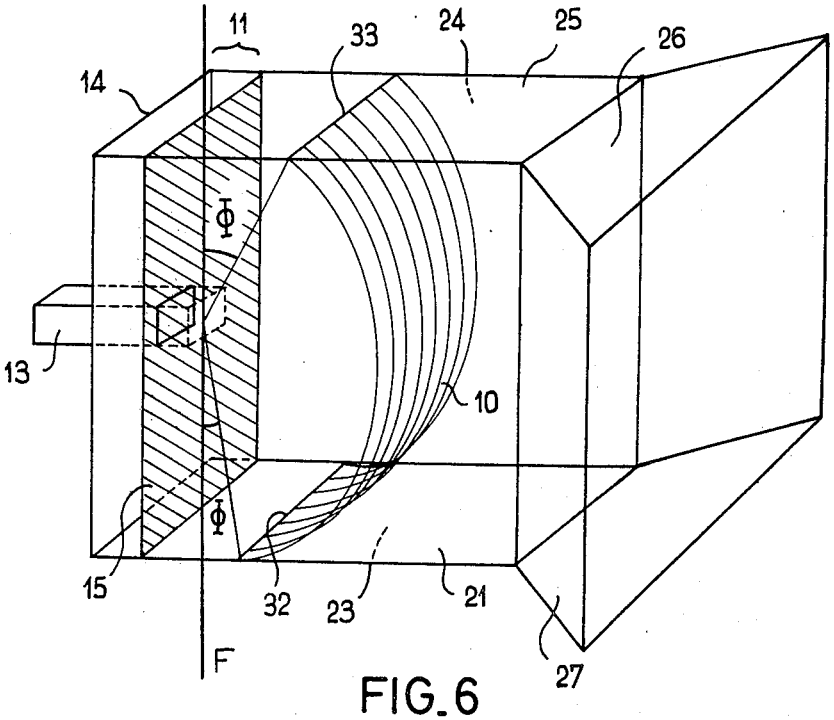

By way of constructional example without any limitation being implied, the dimensions of the box in the case of an operating frequency of 1300 MHz are as follows:

in the case of the polarizing end-wall reflector: 0.165 m×4 m in the case of the large side-walls perpendicular to the end-wall: 1.50 m×4 m in the case of the real focal distance: 1.20 m In FIG. 5, the edges 29 and 28 of the cylindrical-parabolic array 10 are not in the focal plane but make a non-zero angle $\Phi$ with said array. The fact of closing said edges by solid metal plates 30 and 31 on the focal plane makes it possible to increase the gain of the antenna to an appreciable extent. This alternative embodiment is also applicable to the case of the antenna which is placed within a parallelepipedal box as shown in FIG. 6.

It is in fact apparent from this figure that the edges 32 and 33 of the cylindrical-parabolic array 10 are inclined with respect to the focal line F at a non-zero angle $\Phi$.

By virtue of the principle of rotation of the plane of polarization of the wave emitted by the excitation source which permits the construction of a folded optical system, the antenna according to the invention is of small overall length along its focal axis. This accordingly results in a reduction both in volume and in weight while maintaining the same radioelectric characteristics as those exhibited by a conventional parallel-plane antenna.

Potential applications of the parallel-plane antennas according to the invention include monitoring and target-locating. They have the same functions as the parallel-plane antennas of the prior art but are less costly to manufacture in the case of the antenna itself and its drive mechanisms.

What is claimed is:

1. A parallel-plane antenna comprising two parallel metal plates limited by a cylindrical-parabolic end-wall illuminated by a source, said source being placed on the focal line of said antenna at an equal distance from the two plates, at the rear of said antenna on the opposite side of the emitted wave and said cylindrical-parabolic end-wall comprising a semitransparent reflector and said plane at right angles to the plates and containing the focal line being formed by a polarizing reflector unit.

2. A parallel-plane antenna as claimed in claim 1, wherein said semitransparent cylindrical-parabolic end-wall reflector is formed by an array of wires which are parallel to said plane of polarization of the wave emitted by said source and are disposed on a cylindrical-parabolic surface.

3. A parallel-plane antenna as claimed in claim 1, wherein said plane polarizing reflector unit is formed by a reflecting plate and a grid for producing rotation of the plane of polarization of the incident wave, the distance between said reflecting plate and said grid being substantially equal to one-quarter wavelength at the center frequency of the operating band, said plate and said grid being pierced at the level of the source placed behind said reflecting plate.

4. A parallel-plane antenna as claimed in claim 3, wherein said grid for producing rotation of polarization is formed by an array of parallel wires inclined at an angle of 45° with respect to the plane of polarization of the incident wave.

5. A parallel-plane antenna as claimed in claim 1, wherein metal plates constitute with said plane reflector unit a box having the shape of a rectangular parallelepiped.

6. A parallel-plane antenna as claimed in claim 4, wherein the wires of said grid for producing rotation of polarization are embedded in a glass-resin complex.

7. A parallel-plane antenna as claimed in claim 1, wherein the edges of said cylindrical-parabolic array of parallel wires are located in the plane containing the focal line of said antenna.

8. A parallel-plane antenna as claimed in claim 1, wherein the dihedral angle between the edges of said cylindrical-parabolic array and said focal plane of the antenna is different from zero, the junction between said array and said focal plane being formed by solid metal plates located at right angles to said focal plane.

9. A parallel-plane antenna as claimed in claim 1, wherein said radiation source is a monomode horn placed on the focal line of the antenna at mid-height between the two parallel metal plates.

10. A parallel-plane antenna as claimed in claim 1, wherein said radiation source is a multimode source.

11. A parallel-plane antenna as claimed in claim 1, wherein said parallel plates are constituted by two metal plates which form with two other metal plates at right angles thereto a box having the shape of a rectangular parallelepiped, the open end of said box being remote from the plane polarizing reflector unit.

12. A parallel-plane antenna as claimed in claim 11, wherein the opening of said box has a flared-out portion in the shape of a horn in the direction of emission of radiation.

* * * * *